US009625207B2

(12) United States Patent
Afolabi

(10) Patent No.: US 9,625,207 B2
(45) Date of Patent: Apr. 18, 2017

(54) BEVERAGE COOLING DEVICE

(71) Applicant: Oluwafemi Ajibola Afolabi, Mississauga (CA)

(72) Inventor: Oluwafemi Ajibola Afolabi, Mississauga (CA)

( * ) Notice: Subject to any disclaimer, the term of this patent is extended or adjusted under 35 U.S.C. 154(b) by 0 days.

(21) Appl. No.: 14/817,353

(22) Filed: Aug. 4, 2015

(65) Prior Publication Data

US 2016/0069608 A1 Mar. 10, 2016

(30) Foreign Application Priority Data

Sep. 4, 2014 (CA) ..... 2861679

(51) Int. Cl.
*F25D 31/00* (2006.01)
*F25D 5/02* (2006.01)

(52) U.S. Cl.
CPC ..... *F25D 31/007* (2013.01); *F25D 5/02* (2013.01); *F25D 2331/803* (2013.01)

(58) Field of Classification Search
CPC ..... F25D 5/02; F25D 31/007; F25D 2331/803
See application file for complete search history.

(56) References Cited

U.S. PATENT DOCUMENTS 4,784,678 A * 11/1988 Rudick ..... F25D 5/02 206/217
6,103,280 A * 8/2000 Molzahn ..... A23G 9/00 426/109
6,141,970 A * 11/2000 Molzahn ..... A23G 9/00 126/263.01
6,151,911 A * 11/2000 Dando ..... F25B 17/08 62/371
6,178,753 B1 * 1/2001 Scudder ..... A47J 36/28 126/263.08
2005/0126208 A1 * 6/2005 Yang ..... F25D 3/08 62/457.4
2006/0242990 A1 * 11/2006 Kao ..... F25D 3/08 62/457.4
2012/0204578 A1 * 8/2012 Leavitt ..... F25D 5/02 62/4

FOREIGN PATENT DOCUMENTS

DE 10214857 A1 10/2003
KR 200475106 Y1 11/2014
WO WO 2008/029975 A1 3/2008

* cited by examiner

*Primary Examiner* — Ryan J Walters
*Assistant Examiner* — Christopher R Zerphey

(57) ABSTRACT

The present invention is a cooling device having a number of cooling sub-assemblies, each having a body having a top with an opening, and an interior chamber for holding a cooling fluid. An equal number of sub-assembly connectors connect each body to two adjacent bodies so that the cooling device forms a generally cylindrical inner surface that can be placed around the outside of a beverage container so cooling fluid can absorb heat from a beverage in the container. Each sub-assembly may also have an activator bin inside it for storing an endothermic reactant and having a release mechanism that a user can activate to cause the endothermic reactant to mix with the cooling fluid thereby cooling the cooling fluid which in turn cools the beverage.

16 Claims, 4 Drawing Sheets

BEVERAGE COOLING DEVICE

FIELD OF THE INVENTION

The present invention relates generally to devices for cooling liquids in a container, and more particularly to devices that receive cans and bottles for rapidly cooling a beverage contained in the container.

BACKGROUND OF THE INVENTION

Several methods exist for cooling beverages or drinks in open containers such as cups during consumption. A common method is to introduce ice into the beverage in the container. Containers that have narrow openings, for example cans and bottles, are more challenging to cool directly. A common method often employed is to form ice into shapes that can be introduced into the narrow openings of the containers. A limitation of this approach is that ice requires vacant space within the container to prevent overflow. The space required for sufficient cooling using ice is not available in freshly opened beverage cans and bottles.

Another method often employed involves attaching pre-cooled jackets around the container. Ice or freezer gel packs, which are capable of maintaining low temperatures for extended periods, may be used inside these jackets. While this method may be efficient for larger containers such as wine bottles, it is inefficient for smaller containers that require portability. These bulky jackets wrapped around small soda cans, for example, hinder the handling of the container, requiring the beverage consumption to be delayed until sufficient cooling has taken place, and the jacket is removed.

A few approaches have been disclosed to cool or maintain cold beverages in cans while being portable. Ice or gel packs may be shaped to fit the base of cans. Cans are more easily handled while the beverage contents are cooled with these packs. Jackets or wraps made from insulating material, also called "koozies", are formed in the precise dimensions of beverage cans. These devices are limited to the size of the intended containers, and are more effective as insulators rather than cooling devices.

In recent years, technology has been developed to rapid-cool cans and bottles prior to drinking. One such device runs cold water and ice on the outside of the container. Another method involves using specialized cans that store compressed gases or hold vacuums within regions of the cans. By opening valves maintaining the compressed gases or vacuums, heat is drawn when evaporation occurs through heat exchanger units ultimately cooling the beverages contained. These devices do not provide continuous or sustained cooling like ice, or freezer gel, packs. While the former requires considerable preparation time, the latter technology is currently available only in specialized disposable cans.

SUMMARY OF THE INVENTION

The following presents a simplified summary of the disclosure in order to provide a basic understanding to the reader. This summary is not an extensive overview of the disclosure and it does not necessarily identify key/critical elements of the invention or delineate the scope of the invention. Its sole purpose is to present some concepts, disclosed herein in a simplified form as a prelude to the more detailed description that is presented later.

The invention provides a cooling device with multiple cooling sub-assemblies and sub-assembly connectors. Each sub-assembly has a body with an opening in its top and an interior chamber for holding a cooling fluid. Each sub-assembly body also has, an inner wall. Each sub-assembly connector is configured to connect one cooling sub-assembly to an adjacent cooling sub-assembly (so there are always equal numbers of cooling sub-assemblies and sub-assembly connectors in a cooling device). The cooling sub-assemblies are connected together by the sub-assembly connectors and define an interior region for receiving a container. In this way, the cooling device is attachable to a container to substantially surround the container with the inner wall of each cooling sub-assembly body proximate to and in thermal communication with the outer surface of the container. When (i) the cooling device is attached to the container, (ii) the interior chambers of the cooling sub-assemblies contain cooling fluid, and (iii) the container contains liquid having a temperature greater than that of the cooling fluid, then the cooling fluid absorbs beat from the liquid in the container through the outer surface of the container, thereby cooling the liquid in the container.

Each cooling sub-assembly may have, a lid that covers the opening.

The cooling fluid, may be a first endothermic reactant, and each cooling sub-assembly may include an activator bin with an interior chamber for storing a second endothermic reactant. Each activator bin may have a release mechanism, for switching the activator bin from a closed configuration to an open configuration. Each activator bin may be disposed inside the interior chamber of one of the cooling sub-assembly bodies. When there is a second endothermic reactant in one of the activator bins and there is a first endothermic reactant in the interior chamber of the corresponding sub-assembly body, then when the activator bin, is in the closed configuration, the endothermic reactants are isolated from each other. When the activator bin is switched to an open configuration, the second endothermic reactant is then in fluid communication with the interior chamber of the sub-assembly body containing the first endothermic reactant, which causes the endothermic reactants to mix. This results in an endothermic reaction that reduces the temperature of the endothermic reactants.

The release mechanism in each activator bin may include, an ejector that, when the activator bin is in the closed configuration, is disposed in the activator bin. A portion of the ejector then seals an opening in the activator bin in the closed configuration. An end of the ejector may be in contact with the lid of the cooling sub-assembly body and the lid may be configured so that a user can push down on the lid to cause the ejector to move so that the opening in the activator bin is no longer sealed and the activator bin is then in an open configuration.

Each lid may be made from a flexible material that deforms when a user pushes down on it and then returns to its original configuration when the user stops pushing down on it.

The sub-assembly connectors may be integrally formed with the bodies of the sub-assemblies.

The outer surface of the container may be cylindrical. Then the inner walls of the bodies of the cooling sub-assemblies may define a piecewise cylindrical surface having a radius approximately equal to the radius of the outer surface of the container. The cooling device may be attachable to the container by a friction fit between the inner walls of the bodies of the cooling sub-assemblies and the outer surface of the container.

The device may have four cooling sub-assemblies, and when the cooling device is attached to a container, each cooling sub-assembly may then span about 90 degrees about the outer surface of the container.

The cooling sub-assembly bodies and sub-assembly connectors may be made from plastic, and may be transparent. Each of the cooling sub-assemblies may be identical in size and configuration to each other.

The sub-assembly connectors may be made from elastic material.

The cooling sub-assembly bodies may be made from a flexible material so that the shapes and curvatures of the inner walls of the cooling sub-assembly bodies can adapt to the shape and curvature of the outer surface of the container.

The bodies, of the sub-assemblies each may have a curved outer surface so that the assembled cooling device has a piecewise cylindrical outer surface.

The cooling fluid may be water, which may be frozen. The water may contain an additive to reduce its freezing point.

The first endothermic reactant may be water, and the second endothermic reactant may be ammonium nitrate.

DETAILED DESCRIPTION OF THE INVENTION

Figure 1:
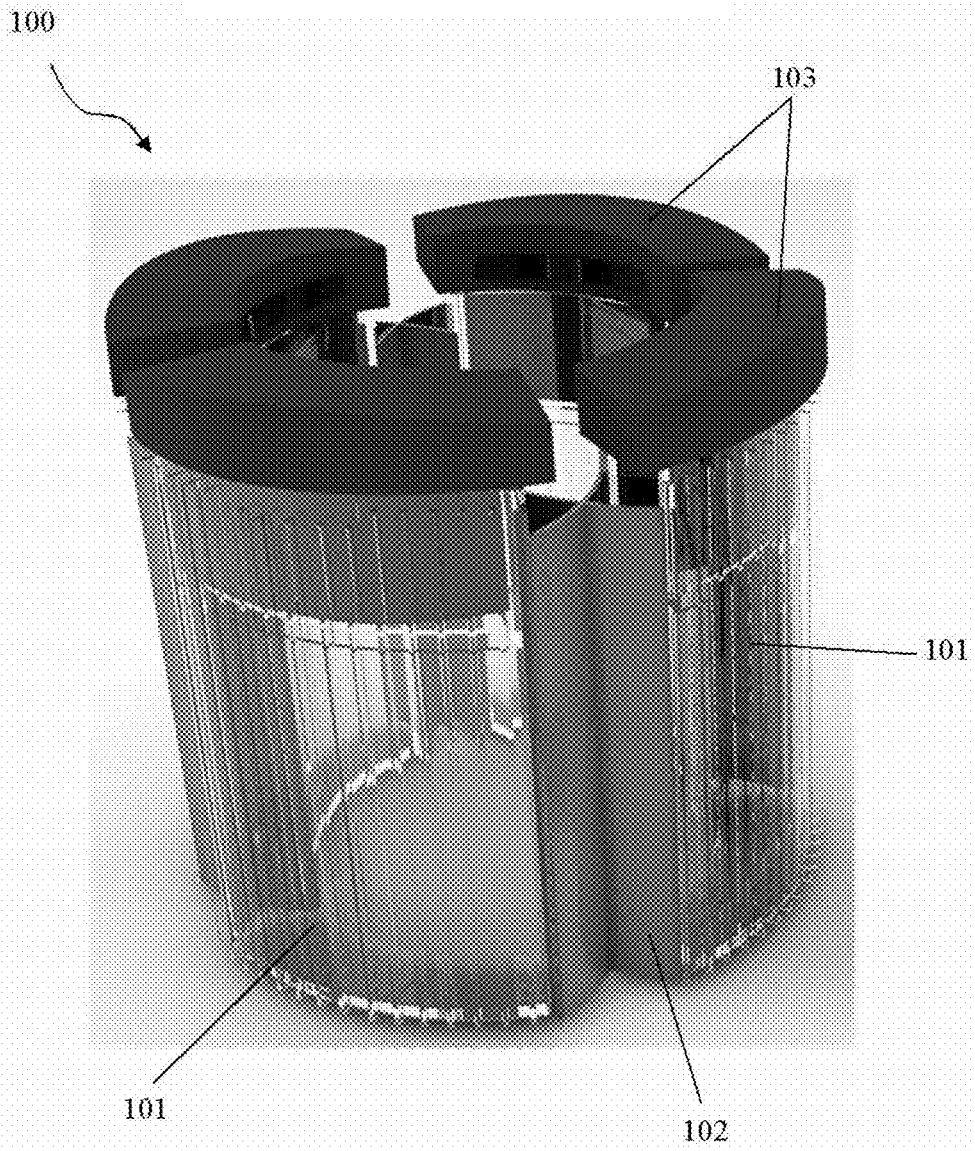
FIG. 1 is a perspective view of a preferred embodiment of the cooling device.

The invention is a reusable cooling device, or "chiller", for cooling liquid in a container. The cooling device is suited to receive bottles and cans of various sizes. Preferred embodiments are configured to be attached to containers containing liquids having an outer surface with a substantially cylindrical portion, such as most cans and bottles used to hold beverages.

The beverage container remains portable while the cooling device is attached to it and its contents are being chilled and consumed. The chiller comprises separate chambers that may have curved geometries. The chambers may be referred to as cooling sub-assembly bodies. These chambers are joined together by attachments referred to as sub-assembly connectors to form an enclosure which may be generally cylindrical so the inner walls of the chambers form a piecewise cylinder (meaning that they are all substantially on the surface of a notional cylinder). By "inner wall" it is, meant the portion of each cooling sub-assembly body that is configured to have the shape of a portion of the outer surface of a container, and is therefore normally shaped as a section of a cylinder (as in the figures), and which, when a container is placed in the interior region defined by the connected cooling sub-assemblies so that the cooling device is attached to the container, is adjacent to and in contact with the portion of the outer surface of the container and in thermal communication therewith so that heat can be exchanged between any liquid in the container and any liquid (cooling fluid) in the cooling sub-assembly body.

When the attachments are made from an elastic material, the enclosure can be expanded by applying force. The device will fit around cans and bottles within a range of circumferences when the size of its enclosure is altered.

The chambers may contain a liquid, or "cooling fluid", such as water which is cooled in a refrigerator, or frozen in a freezer to form ice, prior to use. The water may contain additives to modify (generally to reduce) its freezing point. These additives ma include antifreeze liquids, such as alcohol, or gel substances, such as hydroxyethyl cellulose, a freezing gel. When liquids with low freezing temperatures, such as rubbing alcohol, are blended with water and frozen, a gel comprising of ice and liquid alcohol is obtained. When the walls of the cooling sub-assembly bodies are flexible, such gel (as opposed to ice) facilitates the device to conform to the shape and curvature of various cans and bottles placed within the enclosure formed by the cooling device 100.

The chambers may also contain two endothermic reactants in separate compartments. For example, the first endothermic reactant may be water and the second endothermic reactant may be ammonium nitrate, ammonium chloride, potassium chloride, etc. Urea pellets may alternatively be employed as the second endothermic reactant. When the two endothermic reactants are mixed within one of the chambers, these reactants engage in a reaction that absorbs heat or cools down their environment.

Figure 2:
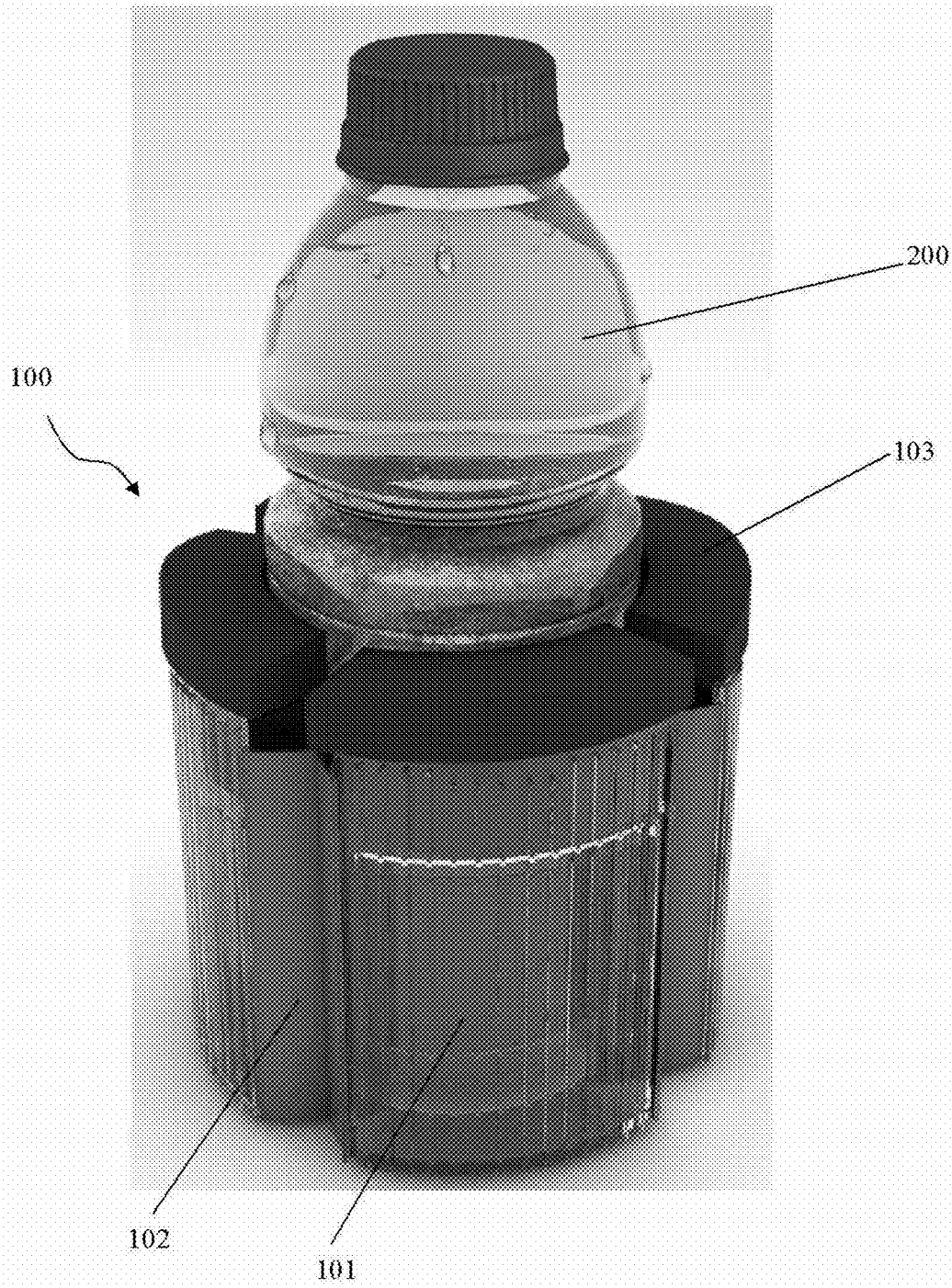
FIG. 2 is a perspective view of the cooling device of FIG. 1 attached to a beverage container.
Figure 3:
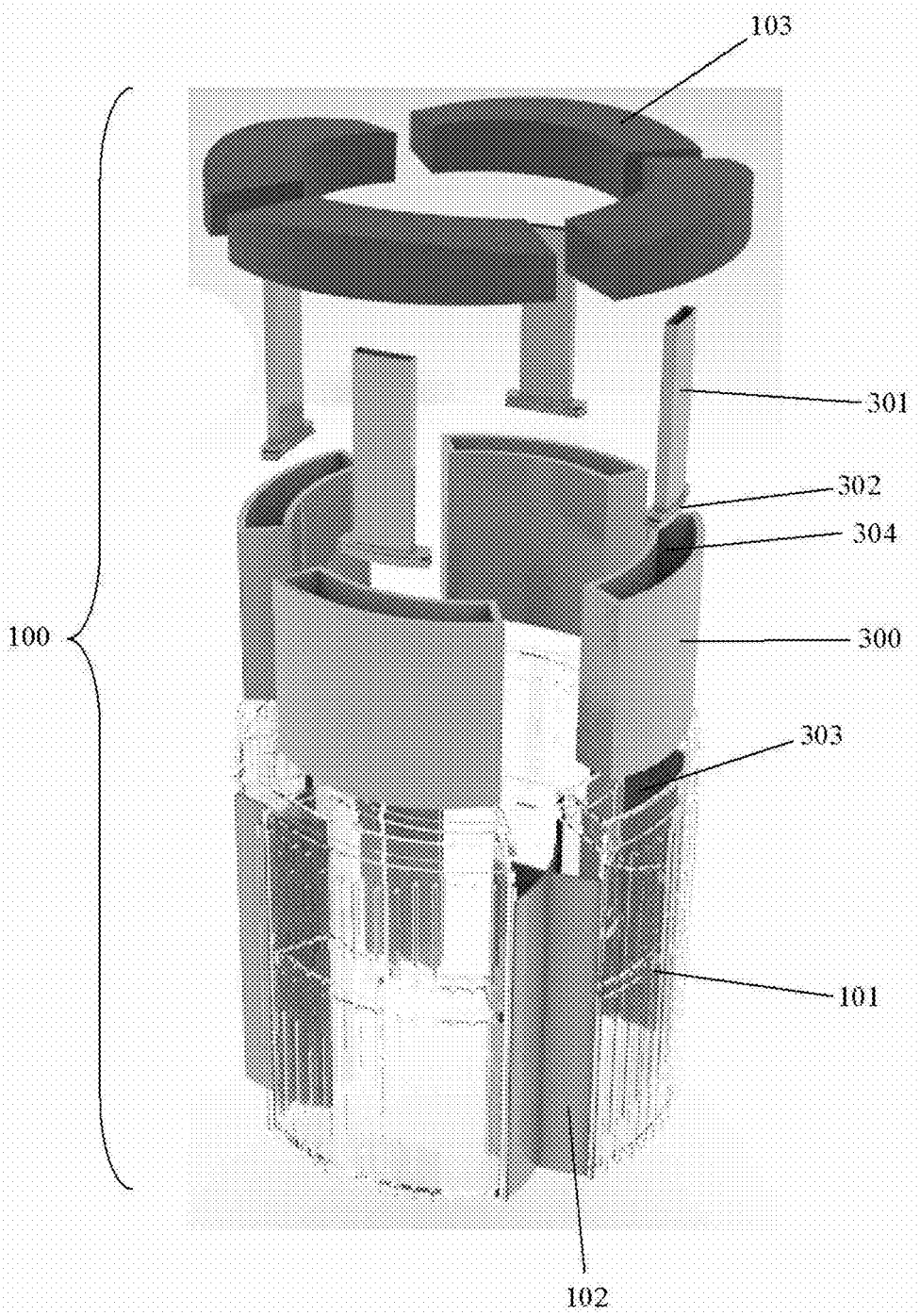
FIG. 3 is an exploded view of a cooling device with the cooling sub-assemblies exploded to show the activator bins and ejectors.

One embodiment of the beverage cooling device 100 is shown in FIG. 1. This preferred embodiment employs four cooling sub-assemblies where each sub-assembly body 101 has curved inner and outer walls configured to follow the outer surface of a cylindrical portion of a beverage container. The inner walls in particular are preferably curved so that they can be placed proximate to a portion of the outer surface of a cylindrical portion of a beverage container 200, as is depicted in FIG. 2. Each cooling sub-assembly body 101 is hollow, having an interior chamber adapted to hold a cooling fluid, such as water or frozen water (ice), which may be an endothermic reactant. Each cooling sub-assembly body 101 has an opening 303 in the top, as can be seen in FIG. 3, for receiving the cooling fluid. Preferably each cooling sub-assembly also has a lid 103 configured to cover the opening 303 to prevent liquid inside the body 101 from escaping, and also to reduce heat transfer between the outside and the interior of the cooling sub-assembly body 101.

In the depicted embodiment, the inner wall of each cooling sub-assembly body 101 spans approximately or somewhat less than 90 degrees of the notional piecewise cylinder formed from the combination of the inner walls of the connected cooling sub-assembly bodies 101. This notional cylinder corresponds to the cylindrical outer surface of a portion of the container 200 so that each inner wall of each cooling sub-assembly body 101 is adjacent to and in thermal communication with a portion of the outer surface of the container 200 when the cooling device 100 is attached to the container 200 as, in FIG. 2. The cooling sub-assembly bodies 101 can be made of any suitable material such as plastic that allows thermal communication between a beverage of liquid inside the container 103 and a cooling fluid contained in, the interior chamber of each cooling sub-assembly body 101. The cooling sub-assembly bodies 101 may be transparent or translucent so that the cooling fluid in each cooling sub-assembly body 101 can be seen, and also so that a user can see whether or not each activator bin 300 has been opened in embodiments with activator bins (as discussed below).

The four cooling sub-assembly bodies 101 are connected together by four sub-assembly connectors 102. Each sub-assembly connector 102 connects one cooling sub-assembly body 101 to an adjacent cooling sub-assembly body 101 so that each cooling sub-assembly body 101 is connected to exactly two other cooling sub-assembly bodies 101 (which is the case in all embodiments with at least three cooling sub-assemblies). The sub-assembly connectors 102 can be separate articles, not permanently attached to the cooling sub-assembly bodies 101, that attach to the cooling sub-assembly bodies 101 by a friction fit or a snap fit, for example, or they may be integrally formed with the cooling sub-assembly bodies 101 (not shown in the figures), or otherwise permanently attached to the cooling sub-assembly bodies 101. The sub-assembly connectors 102 may be made from any suitable material such as plastic, metal, rubber or textile material preferably with elastic properties. The sub-assembly connectors 102 may be cross-links with an "X" shaped profile, as shown in the figures.

When the cooling sub-assemblies are connected together by the sub-assembly connectors 102, they define an interior region for receiving a container. This is the open area surrounded by the inner walls of the cooling sub-assembly bodies 101, which can be seen in FIG. 1 without a container. In FIG. 2, a container 200 has been received into the interior region and the beverage cooling device 100 is attached to the outer surface of the container 200 by a friction fit. This is facilitated by configuring the beverage cooling device 100 so that the diameter of the interior region, which is substantially cylindrical, is, approximately equal to or slightly less than the diameter of a cylindrical portion of the outer surface of the container 200 that is, placed in the interior region.

In some embodiments, the sub-assembly connectors 102 are made from an elastic material so that one cooling device 100 can be frictionally attached to containers of varying circumferences by stretching the sub-assembly connectors 102. By employing such elastic sub-assembly connectors 102 and configuring the cooling device 100 so that the notional piecewise cylinder formed by the inner surfaces of the cooling sub-assembly bodies 101 has a slightly smaller radius than does the cylindrical portion of the outer surface of the container to which the cooling device 100 is designed to be attached when the connectors are not stretched, the sub-assembly connectors 102 must then be stretched somewhat to attach the cooling device 100 to the container 200 so that the stretched sub assembly connectors 102 then provide inward force to retain the cooling device 100 in attachment with the container 200.

In a preferred embodiment depicted in an exploded view in FIG. 3, the cooling device 100 further includes four activator bins 300, each being disposed inside the interior chamber of one of the cooling sub-assembly bodies 101. The activator bins 300 may each, for example, have a volume that is 15% to 40% of the volume of one of the interior chambers of the cooling sub-assembly bodies 101. Each activator bin 300 has an interior chamber for storing a second endothermic reactant. Each activator bin 300 has a release mechanism for switching the activator bin from a closed configuration to an open configuration. In the closed configuration, the second endothermic reactant in the activator bin is isolated from the cooling fluid in the interior chamber of the sub-assembly body, which is a first endothermic reactant. When the activator bin is switched to an open configuration, the second endothermic reactant flows through an opening 400 in the activator bin into the interior chamber of the sub-assembly body containing the first endothermic reactant. This causes the endothermic reactants to mix, resulting in an endothermic reaction that reduces the temperature of the endothermic reactants. Since the inner surfaces of the cooling sub-assembly bodies 101 are adjacent to the outer surface of the container 200 containing a beverage, the cooled cooling fluid (i.e. the mixed endothermic reactants) then absorbs heat from the beverage in the container 200, thereby cooling the beverage.

Figure 4A:
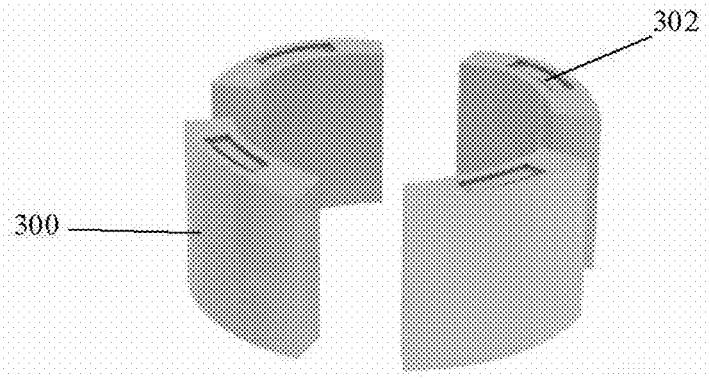
FIG. 4*a* shows a perspective view of the bottom side of four activator bins, with the ejectors positioned so that the activator bins are each in the closed configuration.
Figure 4B:
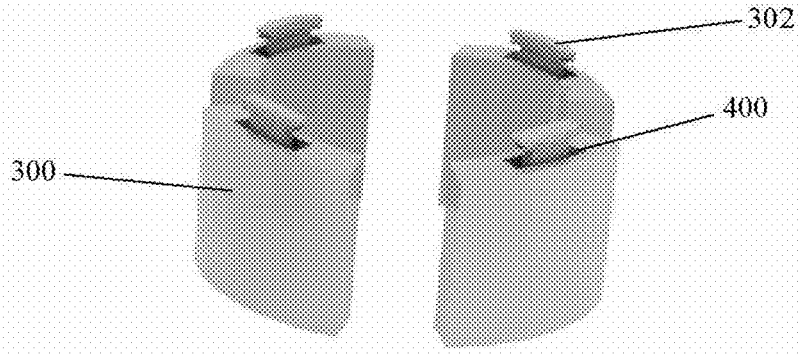
FIG. 4*b* shows a perspective view of the bottom side of four activator bins, with the ejectors positioned so that the activator bins are each in an open configuration.
Figure 4C:
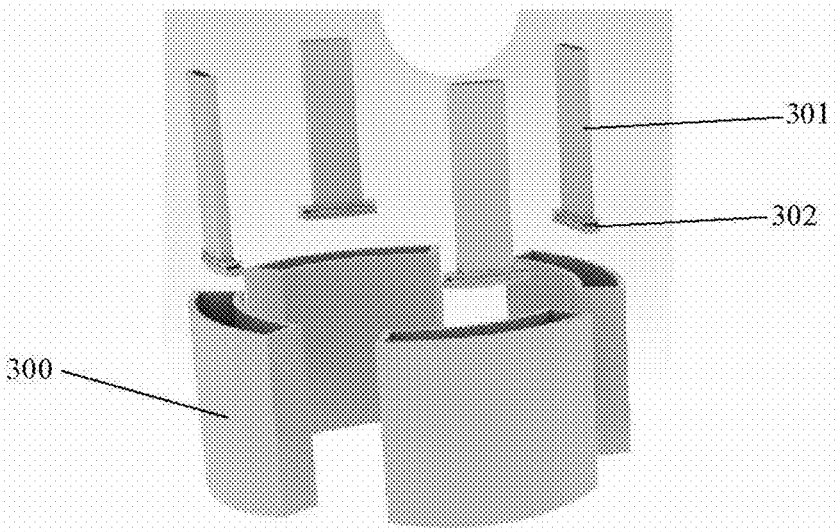
FIG. 4*c* shows a perspective view of the top side of four activator bins, with the ejectors positioned above the activator bins before they are inserted into the bins.

In the embodiment shown in FIG. 3, the release mechanism employs an ejector 300 with a relatively long and thin shaft and a wider bottom end 302 that is sized to seal an opening 400 in the bottom end of the activator bin 300. This can be best seen in FIG. 4*a* where the activator bins 300 are seen from the bottom, and the bottom ends 302 of the ejectors 300 can be seen to be sealing openings 400 in the bottom end of each activator bin 300. In this preferred embodiment, the lids 103 of the cooling sub-assemblies are flexible and the shafts of the ejectors 301 are sized so that when an activator bin 300 is in the closed configuration with the end 302 of the ejector 301 sealing the opening 400 in the bottom end of the activator bin 300, then the top end of the ejector 301 is adjacent to the bottom side of the lid 103. The ejectors may be initially placed in the closed configuration by a friction fit with the edges of the opening 400 in the bottom end of the activator bins 300. Alternatively a weak (releasable) adhesive or a breakable thin membrane can be employed, for example.

Since the lids 103 are flexible, a user can push down on the lid of a cooling sub-assembly, for example using a thumb, and thereby push the ejector 301 down so that the bottom end 302 of the ejector 301 pushes through the opening 400 in the bottom end of the activator bin 300, thereby moving the activator bin into an open configuration. Such lids 103 may be made, for example, from rubber, synthetic rubber or a foam material. The activator bin 300 is held in the same relative position with respect to the cooling sub-assembly body 101 by a suitable interior configuration of the cooling sub-assembly body 101, such as an inner "shelf" formed from protrusions or a lip on the interior wall of the cooling sub-assembly body 101 at a position in the cooling sub-assembly body 101 that results in the activator bin 300 staying fully disposed inside the cooling sub-assembly body 101 with the ejector in contact with the bottom of the lid 103 when the activator bin 300 is in the closed configuration.

Generally the activator bins are designed for a single use, so that the ejectors 301 do not need to be attached to the lids 103, but rather after the pressure exerted by the user causes the bottom end 302 of an ejector 301 to move out of its initial configuration where it seals the opening 400 in the bottom end of the activator bin 300, then the ejector 301 can simply fall through the opening 400 into the interior chamber of the cooling sub-assembly body 101 with the endothermic reactants that are then mixed together.

As will be evident to skilled persons, various other functionally equivalent release mechanisms may be employed to switch an activator bin from the closed configuration to an open configuration. Generally, it is preferred that a removable sealing portion (like the end 302 of an ejector 301) be used to seal an opening in the activator bin either by a friction, fit, a weak physical bond (such as a thin connecting membrane), or a releasable adhesive, along with a mechanism (such as the shaft of an ejector 301) to allow the user to dislodge the sealing portion and switch the activator bin to an open configuration. Rather than pushing down on a portion of the release mechanism via a flexible lid, other mechanisms to activate the release mechanism may be employed, such as a push button on the outside of the sub-assembly bodies. In other embodiments, a portion of the release mechanism may protrude above the lid so that a user can directly contact it to activate the mechanism.

Of course, the cooling device is not limited to having four cooling sub-assemblies. Any suitable number may be used, with an equal number of sub-assembly connectors. Two, three or five cooling sub-assemblies and sub-assembly connectors in particular may alternatively be employed. Six to eight or more cooling sub-assemblies could alternatively be employed, although such large numbers of cooling sub-assemblies are not preferred. When there are only two cooling sub-assemblies, then each cooling sub-assembly connects at both sides to the other cooling sub-assembly. Otherwise, when there are more than two cooling sub-assemblies, then each cooling sub-assembly connects directly to exactly two other cooling sub-assemblies.

Although the cooling sub-assembly bodies are preferably the same size, so that they are interchangeable, this is not essential. In some embodiments, it may be preferable, for example, to have two cooling sub-assembly with larger cooling sub-assembly bodies and two cooling sub-assembly with smaller cooling sub-assembly bodies, where each of the larger bodies is connected to the two smaller bodies. In embodiments with activator bins and endothermic reactants, the user may thereby have a choice between a lesser cooling effect by activating one of the smaller sub-assemblies, or a greater cooling effect by activating one of the larger sub-assemblies. Of course, the user can always activate multiple, or all the cooling sub-assemblies at substantially the same time to increase the cooling effect of the cooling device.

Although it is preferred that the interior region defined by the inner walls of the cooling sub-assembly bodies be cylindrical, this is because of the fact that most drinking containers have at least a portion of the container with a cylindrical outer surface. Embodiments to support other shapes of containers such as those with polygonal or oval cross sections are also possible.

It should be understood that the above-described embodiments of the present invention, particularly, any "preferred" embodiments, are only examples of implementations, merely set forth for a clear understanding of the principles of the invention. Many variations and modifications may be made to the above-described embodiment(s) of the invention as will be evident to those skilled in the art.

Where, in this document, a list of one or more items is prefaced by the expression "such as" or "including", is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed.

The words "comprises" and "comprising", when used in this specification and the claims, are to used to specify the presence of stated features, elements, integers, steps or components, and do not preclude, nor imply the necessity for, the presence or addition of one or more other features, elements, integers, steps, components or groups thereof.

The scope of the claims that follow is not limited by the embodiments set forth in the description. The claims should be given the broadest purposive construction consistent with the description and figures as a whole.

What is claimed is:

1. A cooling device comprising:

(a) a plurality of cooling sub-assemblies, each sub-assembly comprising a body having a top with an opening, an interior chamber configured to receive and contain a cooling fluid, a lid configured to cover the opening, and an inner wall; and (b) a plurality of sub-assembly connectors, each sub-assembly connector configured to connect one cooling sub-assembly to an adjacent cooling sub-assembly, wherein the cooling sub-assemblies are connected together by the sub-assembly connectors and define an interior region for receiving a container having an outer surface so that the cooling device is attachable to the container to surround the container with the inner wall of each cooling sub-assembly body proximate to and in thermal communication with the outer surface of the container, wherein the cooling fluid is a first endothermic reactant, and each cooling subassembly further comprises an activator bin having an interior chamber for storing a second endothermic reactant and having a release mechanism for switching the activator bin from a closed configuration to an open configuration, each activator bin being disposed inside the interior chamber of one of the cooling sub-assembly bodies, wherein, in the closed configuration with the cooling device attached to the container, the container containing liquid, the second endothermic reactant in one of the activator bins and the first endothermic reactant in the interior chamber of the corresponding subassembly body, the endothermic reactants are isolated from each other, and in the open configuration, the second endothermic reactant is in fluid communication with the interior chamber of the cooling sub-assembly body containing the first endothermic reactant, causing the endothermic reactants to mix, resulting in an endothermic reaction that reduces the temperature of the endothermic reactants causing the endothermic reactants to absorb heat from the liquid in the container through the outer surface of the container, wherein the release mechanism in each activator bin comprises an ejector, and in the closed configuration, the ejector is disposed in the activator bin so that a portion of the ejector seals an opening in the activator bin, wherein an end of the ejector is in contact with the lid of the cooling sub-assembly body and the lid is configured so that a user can push down on the lid to cause the ejector to move so that the opening in the activator bin is no longer sealed by the ejector and the activator bin is then in the open configuration.

2. The cooling device of claim 1, wherein there are at least three cooling sub-assemblies, and each cooling sub-assembly is connected to exactly two adjacent cooling sub-assemblies.

3. The cooling device of claim 1, wherein each lid is made from a flexible material that deforms when a user pushes down on the lid, and then returns to its original configuration when the user stops pushing down on the lid.

4. The cooling device of claim 1, wherein the sub-assembly connectors are integrally formed with the bodies of the sub-assemblies.

5. The cooling device of claim 1, wherein the outer surface of the container is cylindrical, and the inner walls of the bodies of the cooling sub-assemblies define a piecewise cylindrical surface having a radius equal to the radius of the outer surface of the container, and the cooling device is attachable to the container by a friction fit between the inner walls of the bodies of the cooling sub-assemblies and the outer surface of the container.

6. The cooling device of claim 5, wherein the device has four cooling sub-assemblies, and when the cooling device is attached to a container, each cooling sub-assembly spans 90 degrees about the outer surface of the container.

7. The cooling device of claim 1, wherein the cooling sub-assembly bodies and subassembly connectors are made from plastic.

8. The cooling device of claim 1, wherein the cooling sub-assemblies are identical in size and configuration to each other.

9. The cooling device of claim 1, wherein the cooling sub-assembly bodies are transparent.

10. The cooling device of claim 1, wherein the sub-assembly connectors are made from elastic material.

11. The cooling device of claim 10, wherein the cooling sub-assembly bodies are made from a flexible material so that the shapes and curvatures of the inner walls of the cooling sub-assembly bodies can adapt to the shape and curvature of the outer surface of the container.

12. The cooling device of claim 1, wherein the cooling sub-assembly bodies each have a curved outer surface so that the assembled cooling device has a piecewise cylindrical outer surface.

13. The cooling device of claim 1, wherein the cooling fluid comprises water.

14. The cooling device of claim 13, wherein the cooling fluid is frozen.

15. The cooling device of claim 13, wherein the water contains an additive to reduce its freezing point.

16. The cooling device of claim 1, wherein the first endothermic reactant is water, and the second endothermic reactant is ammonium nitrate.

* * * * *